US006644248B2

(12) United States Patent
Luckner et al.

(10) Patent No.: US 6,644,248 B2
(45) Date of Patent: Nov. 11, 2003

(54) COOLING SYSTEM FOR AN INTERNAL COMBUSTION ENGINE

(75) Inventors: Jörg Luckner, Kornwestheim (DE); Albrecht Kreissig, Stuttgart (DE); Jürgen Kunze, Rutesheim (DE); Eike Willers, Stuttgart (DE)

(73) Assignee: Behr Thermot-Tronik GmbH, Kornwestheim (DE)

( * ) Notice: Subject to any disclaimer, the term of this patent is extended or adjusted under 35 U.S.C. 154(b) by 0 days.

(21) Appl. No.: 10/154,777

(22) Filed: May 23, 2002

(65) Prior Publication Data

US 2002/0174840 A1 Nov. 28, 2002

(30) Foreign Application Priority Data

Mar. 23, 2001 (DE) ..... 101 27 219

(51) Int. Cl.[7] ..... F01P 7/14
(52) U.S. Cl. ..... 123/41.1
(58) Field of Search ..... 123/41.1

*Primary Examiner*—Noah P. Kamen
(74) *Attorney, Agent, or Firm*—Kennedy Covington Lobdell & Hickman, LLP

(57) ABSTRACT

A cooling system for an internal combustion engine with at least two cylinder rows, in particular for a V-engine for a motor vehicle, has a coolant radiator and a thermostat valve for controlling a flow of coolant from coolant outlets of the cylinder rows, through or bypassing the coolant radiator, and back to the coolant inlets of the cylinder rows. The coolant outlet of one of the cylinder rows is directly connected with an inlet of the coolant radiator, and the coolant outlet of another cylinder row is directly connected with a bypass inlet of the thermostat valve. A bi-directional intermediate line is arranged between the bypass inlet of the thermostat valve and the inlet of the coolant radiator.

13 Claims, 4 Drawing Sheets

COOLING SYSTEM FOR AN INTERNAL COMBUSTION ENGINE

CROSS-REFERENCE TO RELATED APPLICATIONS

This application claims the benefit of German Patent Application Ser. No. 101 27 219.7, filed May 23, 2001.

FIELD OF THE INVENTION

The invention relates to a cooling system for an internal combustion engine that has at least two cylinder rows, such as a V-engine for a motor vehicle. The coolant system includes a coolant radiator and a thermostat valve for controlling the amount of coolant flowing from the coolant outlets of the cylinder rows through the coolant radiator, or through a bypass around the coolant radiator, and back to the coolant inlets of the cylinder rows.

BACKGROUND OF THE INVENTION

Internal combustion engines that have at least two cylinder rows require an increased coolant conducting capacity, because the coolant flowing from each of the cylinder rows must be combined at a point upstream of the coolant radiator in order to permit the coolant to be conducted either through the coolant radiator or through a bypass line. When the coolant is conducted transversely through the cylinder heads of a V-engine that has been installed in the direction of travel (as of a vehicle), and the coolant radiator is installed transversely to the direction of travel, it has heretofore been necessary for structural reasons to conduct the coolant through an elaborate system of conduits in order to achieve an appropriate coolant flow rate, particularly with respect to the combination of coolant flowing from each cylinder row. What is needed, therefore, is a cooling system wherein the coolant flow path is simplified and the requirement of increased coolant conducting capacity is lessened.

OBJECT AND SUMMARY OF THE INVENTION

It is accordingly an object of the present invention to provide a cooling system whose working volume is reduced, which permits the design of the coolant conduit system to be simplified, and which permits the flow path of coolant to be as straight as possible.

This object is achieved in the present invention, a cooling system for an internal combustion engine with at least two cylinder rows, such as and particularly a V-engine. The cooling system has a coolant radiator and a thermostat valve for controlling the amount of coolant flowing from the coolant outlets of the cylinder rows through the coolant radiator or through a bypass around the coolant radiator, and back to the coolant inlets of the cylinder rows. In the present invention, the coolant outlet of one of the cylinder rows is directly connected with the inlet of the coolant radiator, the coolant outlet of another of the cylinder rows is directly connected with the bypass inlet of the thermostat valve, and an intermediate, bi-directional coolant line is present between the bypass inlet of the thermostat valve and the inlet of the coolant radiator.

Depending on the way in which the thermostat valve is set, a portion of the coolant can be allowed either to flow through or to bypass the coolant radiator by changing the direction in which the coolant flows through the intermediate line. Since only that portion of the amount of coolant flowing from one cylinder row flows through the intermediate line, less coolant is needed than in a conventional cooling system, the time required to "warm up" the engine (i.e., for the coolant to reach its optimum temperature) is reduced, and the coolant line leading from the outlet to the thermostat valve may be given a partially reduced cross-section. Moreover, the simplified arrangement of the coolant circuit makes it possible to shorten and straighten the lines leading from the outlet to the radiator and from the radiator to the inlet. This yields a particular advantage when the coolant circuit is designed so that the coolant flows transversely through the cylinder heads of a longitudinally installed V-engine, since, in conventional cooling systems, designing a transverse flow requires a long and complicated line course.

In connection with a further development of the invention, the intermediate line runs directly along the engine housing, thereby permitting space to be saved. Additionally, the intermediate line is advantageously integrated into a distributing component attached to the engine housing. In such an arrangement, it is not necessary to extend hoses close to the engine, and the required structural space is reduced.

In still a further development of the invention, a coolant pump is disposed between two cylinder rows, and the thermostat valve is advantageously arranged in the area of the coolant outlet of one of the cylinder rows. A connecting line between the thermostat valve and the coolant pump may be advantageously integrated into the distributing component. These measures result in further space savings.

In another development of the invention, two separate coolant circuits, substantially as described above, are provided, one for the cylinder heads and one for the engine blocks, and at least one of the coolant circuits has an intermediate line between two coolant outlets. In connection with such a so-called "split" cooling system having two coolant circuits, the reduced content of the lines is of particular importance. Also, straight, space-saving lines are particularly important with two coolant circuits.

In yet another development of the invention, the intermediate lines are integrated into a distributing component disposed on the engine housing. A pair of coolant lines connecting the thermostat valves to the coolant pumps of the coolant circuits are likewise advantageously integrated into the distributing component.

These measures result in a substantial space savings, and because the lines are integrated into the distributing component disposed on the engine housing, the number of separate hose connections in the cooling system may be substantially reduced. Moreover, only the distributing component, and not the engine housing, must be changed if a change in the external coolant circuits is desired.

In still a further development of the invention, the respective thermostat valves of the two coolant circuits are arranged so as to be offset from and next to each other in the longitudinal direction of the internal combustion engine. This enables the fines leading thereto to be crossed more easily, while maintaining or improving the reduction in space requirements.

In yet another development of the invention, the distributing component is made in a single piece, with at least one section of a housing of the thermostat valve integrated into the distributing component. The one-piece design of the distributing component in particular helps to avoid the problem of sealing the connection between the housing and any coolant lines. For example, the distributing component can be produced as an injection-molded plastic part.

BRIEF DESCRIPTION OF THE INVENTION

Further characteristics and advantages of the invention ensue from the claims and the description in connection with the drawings, wherein:

DETAILED DESCRIPTION OF THE PREFERRED EMBODIMENTS

Figure 1:
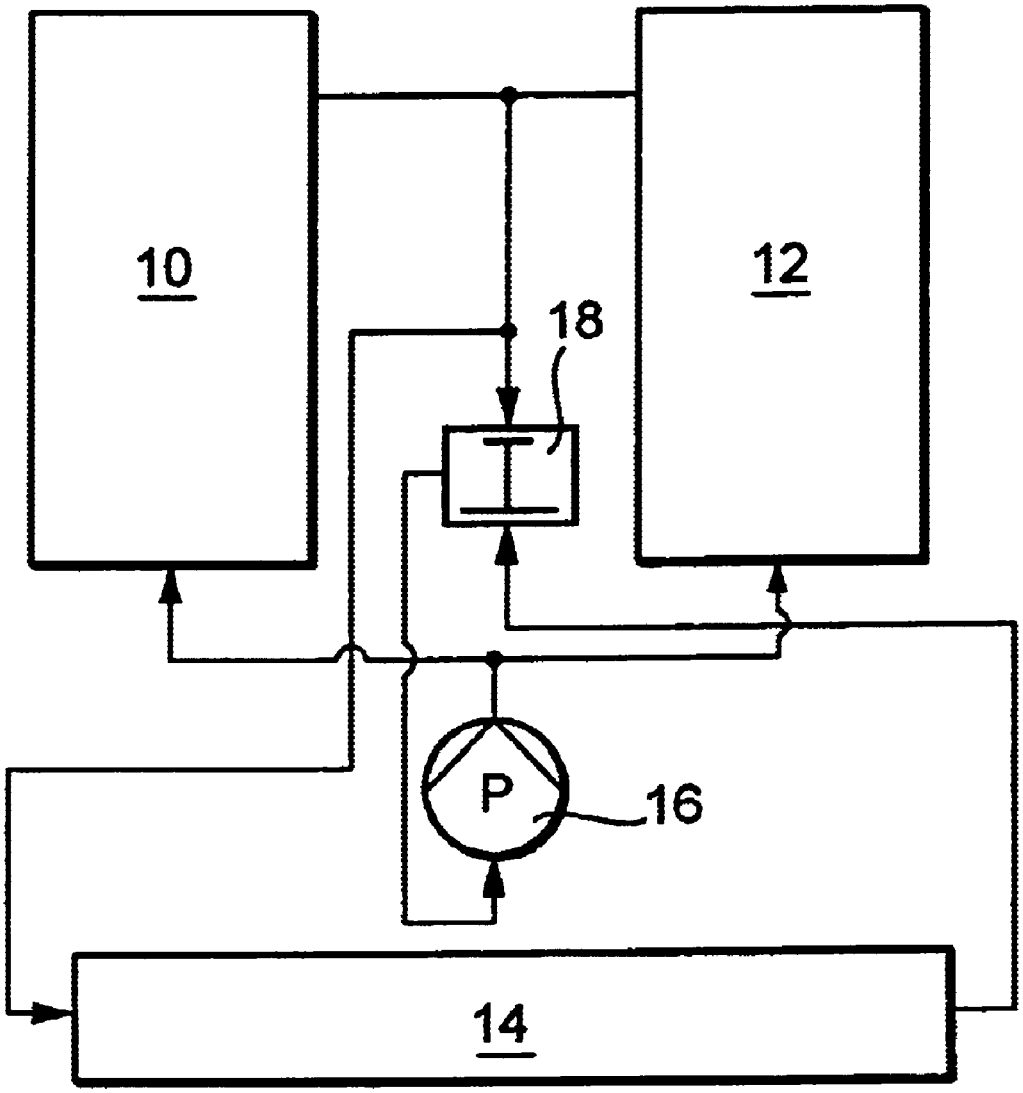
Fig. 1 (PRIOR ART)
FIG. 1 is a schematic view of a conventional cooling system for a V-engine.

Referring now to FIG. 1, a conventional cooling system is shown wherein a longitudinally installed V-engine with a right cylinder row 10 and a left cylinder row 12 (relative to the direction of travel) is cooled by means of a radiator 14. The cooling system has a coolant pump 16, as well as a thermostat valve 18.

When the thermostat valve 18 is in a first position, coolant is conducted from the coolant pump 16 through the cylinder rows 10, 12 (longitudinally in the direction of travel), through the coolant radiator 14, through the thermostat valve 18 and back to the coolant pump 16. In a second, bypass position, the coolant is conducted so as to bypass the radiator 14, from the coolant pump 16 through the cylinder rows 10, 12, through the thermostat valve 18, and back to the coolant pump 16.

As the coolant exits from the cylinder rows 10, 12, the coolant lines are brought together. Starting at the coolant outlet from the cylinder rows 10, 12, and up to the inlet into the radiator 14, it is necessary for the total flow cross-section to provide for the entire flow in both cylinder rows 10, 12. Likewise, the bypass line leading from the thermostat valve 18 to the coolant pump 16 must have sufficient capacity to handle the entire flow cross-section.

Figure 2:
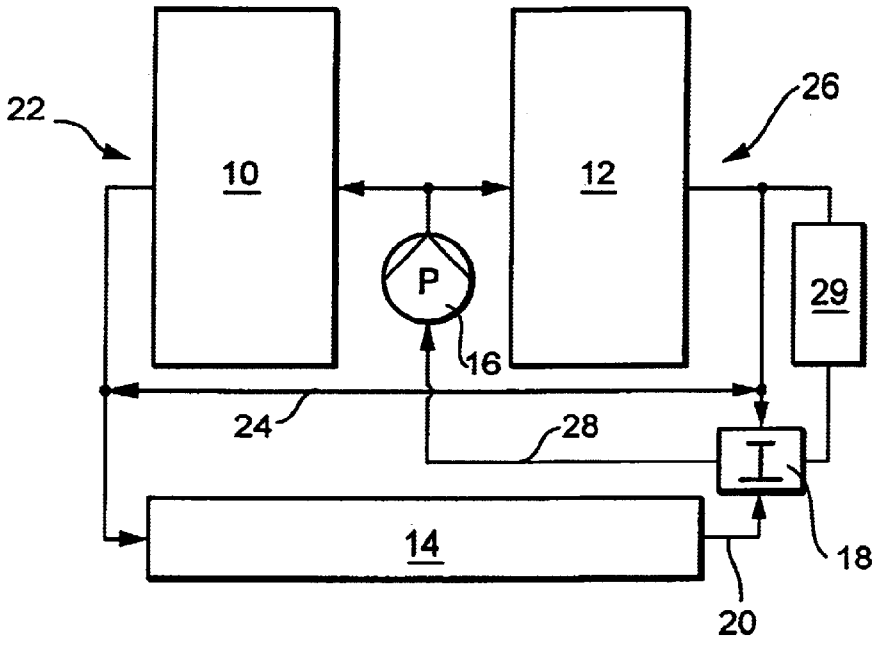
FIG. 2 is a schematic top view of a cooling system according to the present invention for a V-engine in accordance with a first preferred embodiment.

Referring now to FIG. 2, a first preferred embodiment of the cooling system of the present invention is shown in schematic format. For comparison purposes, those components depicted in FIG. 2 that have the same function as those in the conventional cooling system as in FIG. 1 have been provided with the same reference numerals. In a cooling system in accordance with the present invention in FIG. 2, however, the flow of coolant through the cylinder rows 10,12 is transverse with respect to the direction of travel. This arrangement is desirable because the cylinders may be cooled more evenly, which permits more even wear.

In the cooling system depicted in FIG. 2, the coolant flows through the coolant pump 16 and through the left and right cylinder rows 10, 12. If the thermostat valve 18 is positioned to block an outlet line 20 of the radiator 14, coolant flows from the coolant outlet 22 of the right cylinder row 10 through an intermediate line 24 to the bypass inlet of the thermostat valve 18. From the left cylinder row 12, coolant flows from a coolant outlet 26 to the bypass inlet of the thermostat valve 18. From the thermostat valve 18, the coolant is directed through connecting line 28 to the coolant pump 16. Thus, no coolant flows through the coolant radiator 14 when the thermostat valve 18 is in the bypass position. One half of the entire coolant flow, specifically the coolant flow originating at the cylinder row 10, flows through the intermediate line 24.

After the coolant has been sufficiently heated in the coolant circuit, the thermostat valve 18 assumes a second position, at which the outlet line 20 coming from the radiator 14 is opened and the bypass inlet of the thermostat valve 18 is closed. For the sake of a simplified representation, only the extreme positions of the thermostat valve 18 will be explained, but intermediate positions are also possible. In this second position of the thermostat valve 18 coolant flows, starting at the coolant pump 16, through the right cylinder row 10 and from the coolant outlet 22 to the coolant radiator 14. The coolant flowing through and exiting the left cylinder row 12 through coolant outlet 26 flows through the intermediate line 24 (albeit in the opposite direction from the bypass phase) and reaches the inlet of the coolant radiator 14. Thus only one half of the coolant flow, specifically the coolant flow emanating from the left cylinder row 12, passes through the intermediate line 24. The entire coolant flow reaches the thermostat valve 18 through the outlet line 20 of the coolant radiator 14 and is conducted through the connecting line 28 back to the coolant pump 16.

Depending on the position of the thermostat valve 18, a portion of the entire coolant flow flows in one direction or the other through the intermediate line 24. It is already possible to determine from the schematic representation in FIG. 2 that because of this arrangement it is possible to place the coolant lines quite directly between the coolant outlets 22, 26 and the radiator 14, or the thermostat valve 18, because the coolant outlet 22 is directly connected with the inlet of the radiator 14, and the coolant outlet 26 directly with the bypass inlet of the thermostat valve 18. Since only one half of the total coolant flow ever passes through the intermediate line 24, intermediate line 24 may have a reduced cross-section with respect to conventional systems. For instance, in comparison with the conventional cooling system in FIG. 1, in which each line must be able to handle the entire amount of coolant flow, the amount of coolant in the lines is reduced, and the warm-up phase is shortened.

So that an even flow passes through both cylinder rows 10, 12, it is possible, for example, to employ baffles or different line cross sections. A heater 29 for the passenger compartment, or an oil cooler, can be integrated into the cooling system. The thermostat valve 18 can also be designed in such a way that at low numbers of revolutions the thermostat valve 18 at least partially blocks a bypass by means of a spring in order to improve the flow through the heater 29. As can be seen from the above description, the intermediate line 24 can be directly connected with the coolant outlets 22, 26 at the cylinder rows 10, 12, or with the lines originating at the coolant outlets 22, 26, or directly with the bypass inlet of the thermostat valve 18 and the inlet into the radiator 14.

Figure 3:
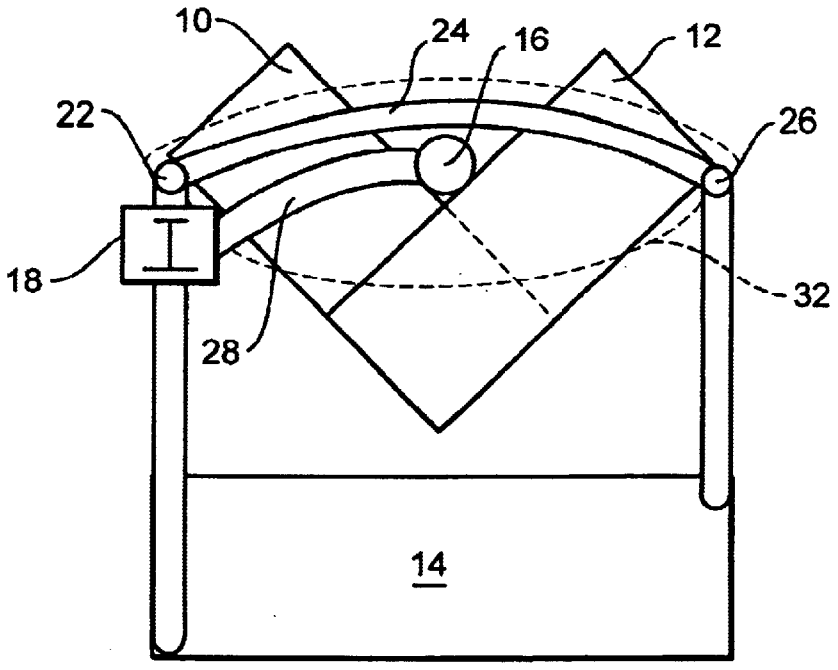
FIG. 3 is a schematic front view of a V-engine with a cooling system as in FIG. 2.

A front view of a V-engine with a cooling system in accordance with a first preferred embodiment of the invention, such as is schematically illustrated in FIG. 2, is shown in a schematic front view in FIG. 3. The V-engine has, as viewed in the direction of travel, a right cylinder row 10 and a left cylinder row 12. The V-engine has been installed in the longitudinal direction behind a vehicle radiator 14. The right cylinder row 10 has a coolant outlet 22, and the left cylinder row 12 has a coolant outlet 26. The intermediate line 24 extends along the engine housing of the V-engine in front of the ends of the cylinder rows 10, 12 facing the radiator 14. The intermediate line 24 connects the coolant outlets 22 and 26 of the cylinder rows 10, 12.

The thermostat valve 18 is arranged in the area of the coolant outlet 22 of the cylinder row 10. The coolant pump 16 is arranged between the cylinder rows 10, 12. The connecting line 28 from the thermostat valve 18 to the coolant pump 16 runs in front of the end of the cylinder row 10 facing the radiator 14.

Connecting line 28 and intermediate line 24, are preferably integrated into a distributing component 32, which is disposed on the engine housing in front of the ends of the cylinder rows 10, 12 facing the radiator 14. The shape of distributing component 32 will depend largely upon the shape of the engine housing to which it is mounted, but will preferably be formed in a plate shape with the coolant lines integrated therein. In this manner it is possible to arrange the connecting line 28 and the intermediate line 24 to save space within the engine compartment without employing separate flexible hoses.

Figure 4:
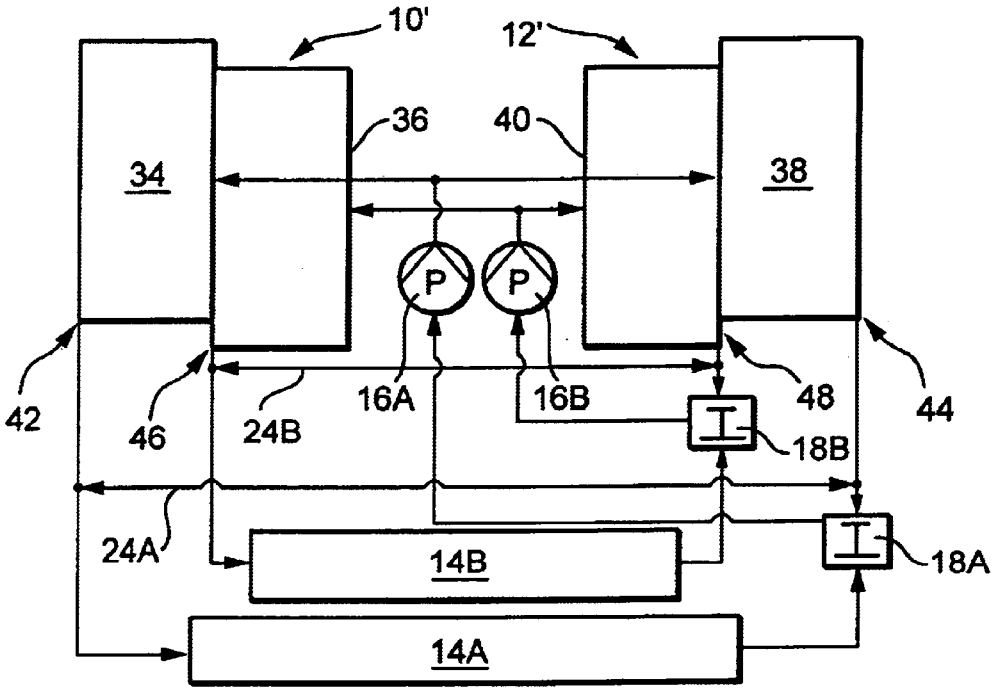
FIG. 4 is a schematic top view of a cooling system according to the present invention in accordance with a second preferred embodiment.

Referring now to FIG. 4, a second preferred embodiment of a cooling system according to the present invention is depicted schematically. The cooling system has been embodied as a so-called "split" cooling system and includes two separate cooling circuits, one for the cylinder heads and one for the cylinder blocks of the cylinder rows 10, 12. The engine represented has, as viewed in the direction of travel, a right cylinder row 10 with a cylinder head 34 and a cylinder block 36, and a left cylinder row 12 with a cylinder head 38 and an engine block 40. The components of the cooling circuit assigned to the cylinder heads 34, 38 are identified by a capital letter A, and the components of the cooling circuit assigned to the cylinder blocks 36, 40 are identified by a capital letter B.

The coolant circuit assigned to the cylinder heads 34, 38 has a coolant pump 16A, from which coolant flows to cylinder heads 34, 38. An intermediate line 24A connects a coolant outlet 42 of the right cylinder head 34 with the coolant outlet 44 of the left cylinder head 38. The coolant outlet 42 is directly connected with the inlet of the radiator 14A, and the coolant outlet 44 is directly connected with a bypass inlet of the thermostat valve 18A. Depending on the position of a thermostat valve 18A, a portion of the entire coolant flow passes in opposite directions through the intermediate line 24A, and the entire coolant flow either reaches a coolant radiator 14A or, in bypass mode, the coolant pump 16A directly via the thermostat valve 18A.

In the coolant circuit assigned to the engine blocks 36, 40, the coolant flows to the cylinder blocks 36, 40 from a coolant pump 16B. An intermediate line 24B connects a coolant outlet 46 of the right cylinder block 36 with a coolant outlet 48 of the left cylinder block 40. The coolant outlet 46 is directly connected with an inlet of the radiator 14B, and the coolant outlet 48 is directly connected with a bypass inlet of the thermostat valve 18B. Depending on the position of a thermostat valve 18B, either the coolant flow emanating from the cylinder block 36 reaches the thermostat valve 18B via the intermediate line 24B, or the coolant flow emanating from the left cylinder block 40 reaches a coolant radiator 14B via the intermediate line 24B. When the system is in a full cooling mode, the whole of the coolant flow is directed through the coolant radiator 14B to thermostat valve 18B, and from there back to the coolant pump 16B. When the system is in a full bypass/warm-up mode, the entire coolant flow bypasses the coolant radiator 14B and reaches the coolant pump 16B directly. In addition to the extreme positions, a part-bypass, part-cooling mode occurs when the thermostat valve is in an intermediate position corresponding with different portions of the coolant flows. For example, at a low number of revolutions, the thermostat valve 18B can block a bypass at least partially in order to improve the flow through a heater or to prevent coolant from flowing through the cylinder blocks 36, 40 in a warm-up phase, so as to save fuel.

Figure 5:
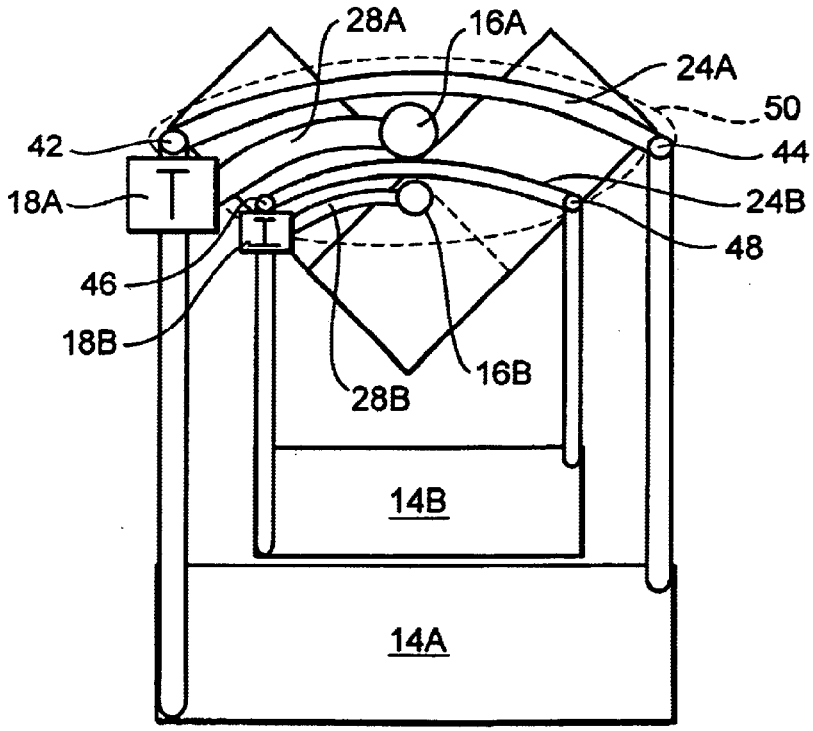
FIG. 5 is a schematic front view of a V-engine with a cooling system as in FIG. 4.

Referring now to FIG. 5, a schematic front view illustrates a V-engine with a cooling system according to the second preferred embodiment of the present invention as in FIG. 4. The V-engine is arranged in the longitudinal direction behind coolant radiators 14A and 14B. As can be seen in FIG. 5, the present invention enables the coolant lines leading from the coolant outlets 44,48 to the coolant radiators 14A, 14B, or those leading from the coolant radiators 14A, 14B to the thermostat valves 18A, 18B, to be shorts and relatively straight.

Coolant pumps 16A, 16B are assigned to the cylinder heads and blocks, respectively, and are preferably disposed between the cylinder rows of the V-engine. This arrangement permits intermediate lines 24A, 24B and connecting lines 28A, 28B to run parallel to each other, without requiring a crossover. Intermediate lines 24A, 24B and connecting lines 18A, 28B can consequently be integrated into a common, flat distributing component 50, which has been only schematically indicated in FIG. 5 by a dashed line. In a preferred embodiment, the distributing component 50 is plate-shaped and is disposed directly on the engine housing of the V-engine in front of the ends of the cylinder rows facing the radiators 14A, 14B. The use of distributing component 50 permits the present invention to be implemented without flexible hose connections, and with a more pleasant, smooth-surface design.

Figure 6:
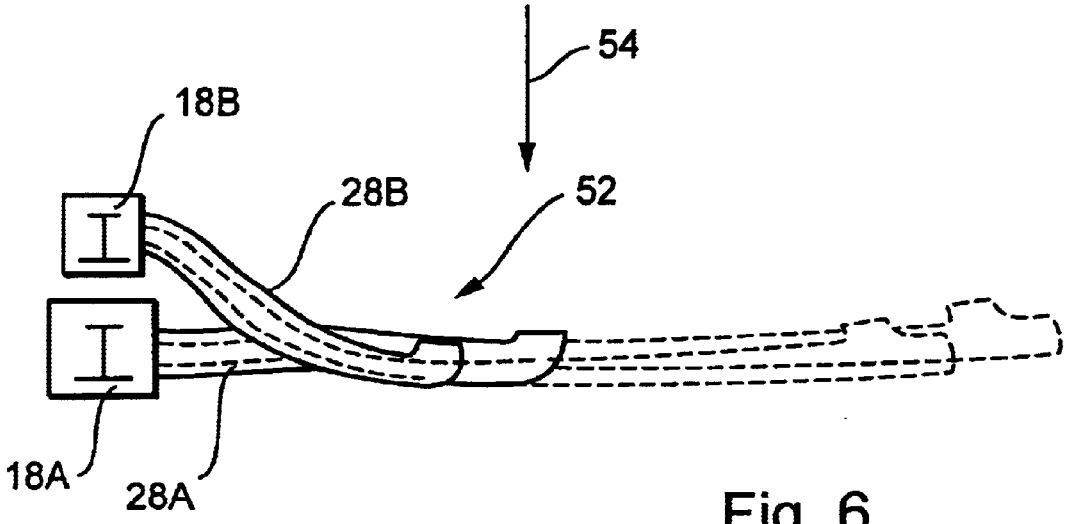
FIG. 6 is a schematic top view of a distributing component according to the present invention.

Referring now to FIG. 6, a distributing component 52 is depicted schematically from above. In order to ease a crossover of connecting lines 28A, 28B, the thermostat valves 18A, 18B are arranged, one behind another, in an offset and adjacent relationship in the longitudinal direction 54 of an engine. Additional coolant lines in the distributing component 52 are indicated in phantom. The sections of the housings of the thermostat valves 18A, 18B, from which coolant lines such as connecting lines 28A, 28B emanate, are integrated into the distributing component 52. The distributing component is therefore producible in one piece, for example, by plastic injection molding.

In view of the aforesaid written description of the present invention, it will be readily understood by those persons skilled in the art that the present invention is susceptible of broad utility and application. Many embodiments and adaptations of the present invention other than those herein described, as well as many variations, modifications, and equivalent arrangements, will be apparent from or reasonably suggested by the present invention and the foregoing description thereof, without departing from the substance or scope of the present invention. Accordingly, while the present invention has been described herein in detail in relation to preferred embodiments, it is to be understood that this disclosure is only illustrative and exemplary of the present invention and is made merely for purposes of providing a full and enabling disclosure of the invention. The foregoing disclosure is not intended nor is to be construed to limit the present invention or otherwise to exclude any such other embodiments, adaptations, variations, modifications and equivalent arrangements, the present invention being limited only by the claims appended hereto and the equivalents thereof.

What is claimed is:

1. A cooling system for an internal combustion engine having at least two cylinder rows each having at least one coolant outlet and at least one coolant inlet, the cooling system comprising:

a coolant radiator; and a thermostat valve for controlling a flow of coolant from the coolant outlets of the cylinder rows, through one of or both the coolant radiator and a bypass around the coolant radiator, and to the coolant inlets of the cylinder rows;

wherein one of the coolant outlets is directly connected to an inlet of the coolant radiator, another of the coolant outlets is directly connected with a bypass inlet of the thermostat valve, and an intermediate line connects the bypass inlet and the radiator inlet.

2. The cooling system of claim 1, wherein the intermediate line runs directly along an engine housing.

3. The cooling system of claim 2, wherein the intermediate line is integrated into a distributing component disposed on the engine housing.

4. The cooling system of claim 3, further comprising:

a coolant line integrated into the distributing component and connecting the thermostat valve to the coolant pump.

5. The cooling system of claim 4, wherein the distributing component is a single piece, and wherein at least one section of a housing of the thermostat valve is integrated into the distributing component.

6. The cooling system of claim 1, further comprising:

a coolant pump disposed between two cylinder rows.

7. The cooling system of claim 1, wherein the thermostat valve is disposed in the area of one of the coolant outlets.

8. A cooling system for an internal combustion engine having at least two cylinder rows each having a set of cylinder heads and a set of cylinder blocks, the cooling system comprising:

a coolant radiator system;

a head coolant circuit including a head coolant inlet and a head coolant outlet for each cylinder row and a head thermostat valve for controlling a flow of coolant from the head coolant outlets of the cylinder rows, through one of or both the coolant radiator system and a bypass around the coolant radiator system, and to the head coolant inlets of the cylinder rows;

a block coolant circuit including a block coolant inlet and a block coolant outlet for each cylinder row and a block thermostat valve for controlling a flow of coolant from the block coolant outlets of the cylinder rows, through one of or both the coolant radiator system and a bypass around the coolant radiator system, and to the block coolant inlets of the cylinder rows;

wherein, for each coolant circuit, one of the coolant outlets is directly connected to an inlet of the coolant radiator system and another of the coolant outlets is directly connected to a bypass inlet of the thermostat valve; and wherein, for at least one of the coolant circuits, an intermediate line connects at least two of the coolant outlets.

9. The cooling system of claim 8, wherein each of the coolant circuits comprises an intermediate line connecting at least two of the coolant outlets.

10. The cooling system of claim 8, wherein the at least one intermediate line is integrated into a distributing component disposed on a housing of the engine.

11. The cooling system claim 10, further comprising, for each coolant circuit, a coolant line connecting the thermostat valve to a coolant pump, wherein each coolant line is integrated into the distributing component.

12. The cooling system of claim 11, wherein the distributing component is a single piece, and wherein at least one section of a housing of each of the thermostat valves is integrated into the distributing component.

13. The cooling system of claim 8, wherein the head thermostat valve is offset from and next to the block thermostat valve in a longitudinal direction of the engine.

* * * * *